US005185068A

United States Patent [19]

Sadoway

[11] Patent Number: 5,185,068

[45] Date of Patent: Feb. 9, 1993

[54] ELECTROLYTIC PRODUCTION OF METALS USING CONSUMABLE ANODES

[75] Inventor: Donald R. Sadoway, Belmont, Mass.

[73] Assignee: Massachusetts Institute of Technology, Cambridge, Mass.

[21] Appl. No.: 697,793

[22] Filed: May 9, 1991

[51] Int. Cl.[5] ..... C25C 3/12; C25C 3/00

[52] U.S. Cl. ..... 204/245; 204/291

[58] Field of Search ..... 204/291, 245, 64 R, 204/64 T, 69, 67

[56] References Cited

U.S. PATENT DOCUMENTS

| | | | |
|---|---|---|---|
| 765,001 | 7/1904 | Gin | 204/225 X |
| 816,142 | 3/1906 | Aikens . | |
| 2,302,604 | 11/1942 | Dolbear | 204/64 R X |
| 2,901,410 | 8/1959 | Dean et al. | 204/64 T |
| 2,939,823 | 6/1960 | Rand | 204/64 T |
| 3,565,917 | 2/1971 | Cervenka et al. | 204/291 X |
| 3,941,668 | 3/1976 | Allan | 204/105 |
| 4,351,705 | 9/1982 | Ernst et al. | 204/108 |
| 4,500,613 | 2/1985 | Galbraith | 429/69 |
| 4,5,97,839 | 7/1986 | Josefowicz | 204/245 X |
| 4,971,633 | 11/1990 | Sadoway et al. | 204/56.1 |
| 4,999,097 | 3/1991 | Sadoway | 204/243 R |

*Primary Examiner*—Donald R. Valentine
*Attorney, Agent, or Firm*—Wolf, Greenfield & Sacks

[57] ABSTRACT

An electrolysis cell for the production of metals is disclosed. Ther cell includes at least one anode that, under the operating conditions of the cell, dissolves into the cell electrolyte to provide a cell feed material. Additionally the anode is fabricated of a material that, under the operating conditions of the cell is electronically conductive as a solid and can provide an ionically conductive medium either when molten or when dissolved in a liuqid.

34 Claims, 1 Drawing Sheet

ELECTROLYTIC PRODUCTION OF METALS USING CONSUMABLE ANODES

FIELD OF THE INVENTION

This invention relates to electrolytic cells for the production of metals, the cells utilizing a consumable anode, consumed by dissolution, so as to provide a dissolution product that serves as a feed material for the cell.

BACKGROUND OF THE INVENTION

A variety of metals having significant industrial uses are not found naturally in their elemental forms. Similarly, a variety of industrially useful metal alloys require costly metal recovery and alloying processes before the alloys can be made available for use. Typically, metals that are not available in their elemental forms are mined as a variety of compounds from which the desirable metal product must be extracted. An example of one such metal is aluminum. Commercially, aluminum is produced from naturally occurring aluminum compounds by the electrolytic reduction of $Al_2O_3$. $Al_2O_3$ is obtained from bauxite ore by the Bayer process which involves digesting crushed bauxite ore in a strong caustic soda solution. In 1886, electrolytic production of aluminum was invented by Charles Hall in the United States and by Paul Heroult in France, each independent of the other. This process, known today as the Hall Heroult process, transformed aluminum from a precious metal into a common structural material. The process is still today the only commercial process for obtaining aluminum metal and is fundamentally the same as it was originally disclosed by Hall and Heroult in 1886. The Hall-Heroult process, cited herein as an exemplary electrolytic metal-production process, relies upon the passage of an electric current through a molten electrolyte containing $Al_2O_3$. An important feature of the Hall-Heroult discovery was that cryolite, a double salt of aluminum and sodium represented by the chemical formula, $Na_3AlF_6$, would dissolve $Al_2O_3$ and that the dissolved $Al_2O_3$ could be electrolytically reduced to molten aluminum metal.

The electrolytic reduction of metals is often performed in large cells or pots. Hall Heroult cells, for example, have massive carbon cathodes on the bottom of the cell and carbon anodes, normally formed in the shape of large blocks, suspended above the cell and capable of being lowered into the electrolyte. Direct electric current is passed from the anode through the electrolyte to the carbon cathodes. During the reduction of $Al_2O_3$, for example, the carbon anodes are consumed in the chemical reaction occurring in the cell. This reaction can be represented as follows:

$$2Al_2O_3+3C \rightarrow 4Al+3CO_2$$

This process yields an aluminum product that is very pure, e.g., 99.0% to 99.8%. The main impurities remaining in the product are traces of iron and silicon In addition to aluminum, fused salt electrolytic processes are currently used to produce other metals including magnesium, sodium, other alkali and alkaline earth metals, and also titanium and rare earth metals Typically, magnesium is produced using either the I. G. Farben process in which the cell feed is anhydrous $MgCl_2$ or the Dow seawater process in which the cell feed is $MgCl_2.1.7H_2O$. The cells are made of steel and may be lined with refractory brick. The cathodes are typically steel and the anodes are typically graphite. During cell operation, molten magnesium is electrochemically reduced at the cathode surface from which it detaches and rises to the surface of the electrolyte. Simultaneously with this, chlorine gas evolves at the anode. In the Dow cell, the removal of water from the cell feed results in anode consumption.

The production of sodium is carried out at approximately 580° C. by the electrolysis of $NaCl-CaCl_2$in the Downs cell, a cell having concentrically arranged graphite anodes and steel cathodes separated by a steel diaphragm. In such a cell, both the molten sodium metal and chlorine gas rise to their respective compartments at the top of the cell.

In the Dow-Howmet process for the production of titanium, $TiCl_2$ is electrolyzed from a KCl-LiCl melt at a temperature of approximately 520° C. The cell typically includes an anode, a deposition cathode and a feed cathode. Generally, the anode is formed of graphite and is surrounded by a diaphragm of reinforced screen coated with either cobalt or nickel. The cathodes are typically formed from steel cylinders and the feed cathode assembly is surrounded by a screen basket with which it makes electrical contact. $TiCl_4$ is added to the feed cathode compartment where it is electrolytically reduced to form $TiCl_2$. At the deposition cathode, the $TiCl_2$ is reduced to titanium metal. An anode gas comprising chlorine and $TiCl_4$ is produced, the latter component being recovered, purified and recycled back as cell feed.

One significant disadvantage of electrolytic processes that use carbon electrodes is the effect of carbon processing and use on the environment. Typically, carbon anodes must comprise high purity carbon which is fabricated by pouring into molds such carbonaceous feedstocks as coal tar and pitch followed by baking at high temperatures for extended periods of time. This process, referred to industrially as a pre bake causes undesirable by products, such as PNA's, PCB's and $SO_2$, to be evolved from the mold. Furthermore, the problem continues during use of the anodes in the electrolysis cell proper and even in subsequent processing of cell products.

In a conventional Hall Heroult cell using pre baked consumable carbon anodes, approximately one half pound of carbon is consumed for every pound of aluminum produced. The consumed carbon issues from the cell as CO and $CO_2$, so-called "greenhouse gases", which are suspected of contributing to long-term global warming. Additionally, the use of carbon anodes tends to result in the generation of significant amounts of carbon dust which can cause health problems for exposed workers. To contend with these problems, industry is forced to resort to complicated filtering, removal and isolation techniques which can reduce process efficiency while increasing capital and operating costs. Carbon consumption is high also in non electrochemical metals production. For example, conventional steel production methods also require the use of a form of carbon called coke. Coke ovens are a further source of carbon based pollution.

In view of the current world wide demand for steel and aluminum and the emerging markets for other ore based metals such as titanium for both industrial and military applications, a need exists for a simple, electrolytic method for the reduction of ores containing such metals into their elemental metal forms. Additionally, due to their sheer volume in the world wide market, a need exists for simple processes that lead to a direct production of metallic alloys such as carbon steel and stainless steel in environmentally acceptable ways.

SUMMARY AND OBJECTS OF THE INVENTION

The invention relates to an electrolytic cell for the production of metals. More specifically, the invention relates to an electrolytic cell having a consumable anode that, during cell operation, will dissolve into a molten electrolyte contained in the cell. The consumable anode constitutes the cell feed which dissolves in the electrolyte and is subsequently electrolytically reduced to product metal.

As such, the present invention is related to an electrolytic cell for the production of metals. This cell includes an anode that, at the operating conditions of the cell, will dissolve to form a dissolution product. This dissolution product comprises a feed material for the cell. Accordingly the anode must comprise a material that, under cell operating conditions, is electronically conductive as a solid and can provide an ironically conductive medium either when molten or when dissolved in a liquid.

Thus, it is one object of the present invention to provide an electrolytic cell having a consumable anode that dissolves to provide at least one component of a feed material for the cell.

It is a further object of the invention to provide an electrolytic cell that eliminates the need to provide an additional feed source.

It is still a further object of the invention to provide an anode that can be electrolytically reduced to a cell product.

It is another object of the invention to provide an electrolytic process for the production of metals which reduces or eliminates the need to use carbon electrodes in electrolytic reduction cells.

It is yet another object of the invention to provide an electrolytic cell that allows the direct production of various metal alloys, the production of which heretofore has required numerous process steps and used reactants that are environmentally unacceptable.

DETAILED DESCRIPTION OF THE INVENTION

Figure 1:
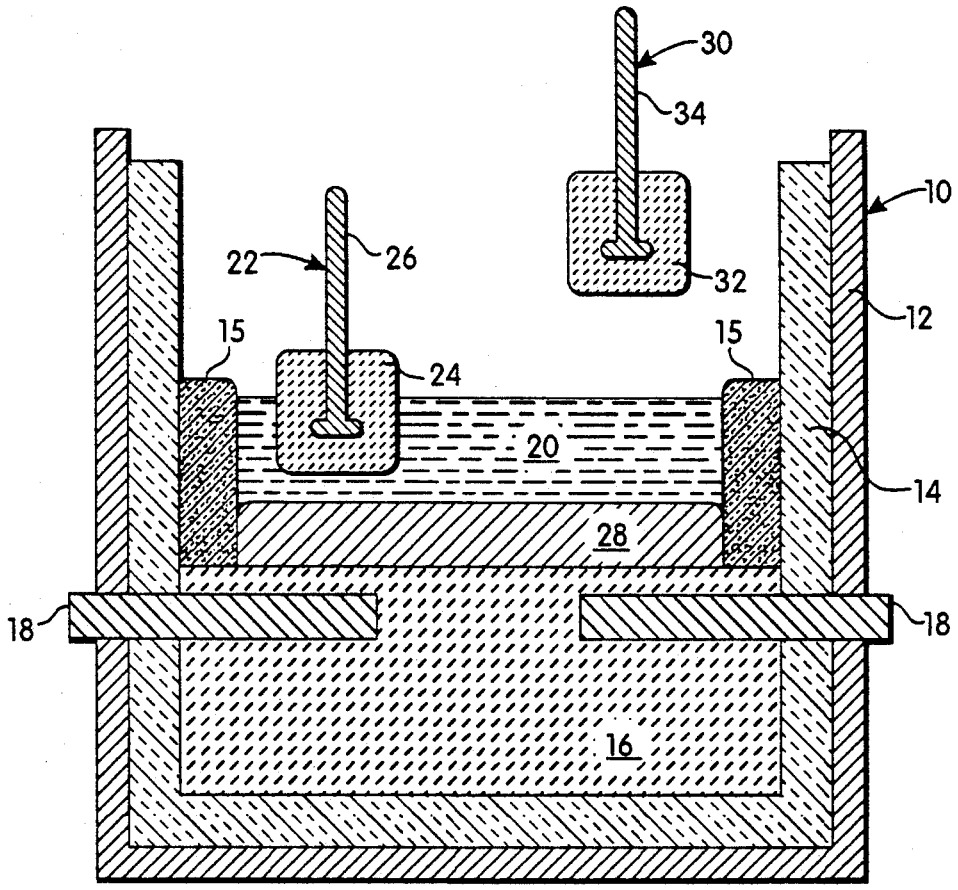
FIG. 1 is a schematic representation of an electrolytic cell employing an anode that dissolves to provide the cell feed material.

The invention is an electrolytic cell for the production of metals that includes an anode which, during the operation of the cell, will be consumed and in so doing, will provide the cell with feed material which, under cell operating conditions, will be electronically conductive as a solid and can provide an ironically conductive medium either when molten or when dissolved in a liquid. Of course, the invention further requires, that the anode material be selected to be a material that, once electrolytically reduced, will yield a desired product.

In a preferred embodiment, the invention comprises an electrolytic cell that utilizes, as an electrolyte, a molten oxide. Such electrolytes typically melt at temperatures significantly higher than common chloride-based electrolytes or even fluoride based electrolytes such as cryolite. The higher melting temperature of the electrolyte requires a higher temperature for operation of the cell but allows certain materials, such as for example titanium oxide, to become in their solid state electronically conductive to a satisfactory degree. In contrast, molten cryolite solutions are stable at temperatures in the vicinity of 1000° C. At these temperatures, an anode fabricated of titanium oxide would not exhibit a sufficient degree of electronic conduction to be conductive of electrical current in a manner satisfactory for cell operation. Rather, such a cell would inherently have a large specific electrical power consumption.

Conversely, a cell using a molten oxide could be operated at a temperature high enough to render a variety of semiconducting oxides as satisfactory electrical conductors from the standpoint of their use as electrodes in industrial electrolytic cells. Following the example provided above, the present invention would allow the electrolytic extraction of titanium metal directly from a molten oxide electrolyte fed with a titanium oxide anode.

Specifically, such a system would preferably include a molten oxide based electrolyte containing $TiO_2$ and other oxides more reactive than titanium, such as for example, oxides of lithium, calcium or both. Such an electrolyte would have a melting point of approximately 1300° C. and would be useful in industrial electrolytic cells at temperatures exceeding 1675° C., the melting point of titanium metal.

The anode preferably comprises a solid $TiO_2$ monolith. As one example, the anode can be fabricated by consolidating $TiO_2$ powder by a process such as sintering. Since $TiO_2$ is a semiconductor, if raised to a sufficiently high temperature, it will carry enough electrical current by electronic conduction to satisfy the operating requirements of an industrial electrolytic reduction cell.

During operation of such a cell, the electrode reactions would result in the production of titanium metal at the cell cathode and the evolution of oxygen gas at the cell anode. Unlike a conventional Hall cell, since the present cell would include no carbon, fluoride or sulfur, none of the undesirable emissions of Hall cell chemistry would issue.

Additionally, the present cell preferably would be operated at a temperature above the melting temperature of the product metal. Thus, for titanium, (melting point: 1675° C.), the cell could be operated at a temperature sufficiently high to produce a molten titanium product. Since titanium metal electrolyzed in solid form is dendritic and in need of further processing such as washing to remove entrained electrolyte and remelting to render metal ingot, the ability to produce molten product is particularly advantageous. Thus, the invention would provide the ability to produce liquid titanium metal directly via a process far simpler than the presently employed methods involving the metallothermic reduction of titanium tetrachloride ($TiCl_4$). Additionally, since $TiCl_4$ is generally formed by carbochlorination of $TiO_2$ in a process using carbon in the form of coke and chlorine gas, the ability to directly produce elemental titanium removes several carbon-intensive process steps and at the same time reduces significantly the adverse environmental effects.

Like titanium elemental uranium could also be electrolytically reduced directly from $UO_2$. Such a process would eliminate multiple process steps that are currently employed in the recovery of uranium from its native ore. In this case, a molten oxide based electrolyte containing $UO_2$ and oxides of metals more reactive than uranium (Mg and Ca, for example) could be used in connection with a monolithic $UO_2$ anode.

As another example, the present invention could be used for the direct electrolytic extraction of steel. In use, a steel production cell would preferably include an electrolyte comprising a molten oxide. The anode would be a consumable anode comprising iron oxide which, upon dissolution, provides the cell feed material. Additionally, carbon could be fed into the electrolyte directly, e.g. by gas such as methane, thereby resulting in a metal product containing a predetermined amount of carbon.

In the case of the electrolytic production of stainless steel, it is noted that oxides of iron, chromium and nickel, the metallic components of stainless steel, are excellent electronic conductors at elevated temperatures. Thus, the present invention includes the use of a sintered anode formed of a mixture of oxides of iron, chromium, and nickel in appropriate ratios so that upon electrolysis, a liquid iron chromium nickel alloy would be formed having a predetermined composition of the desired stainless steel.

Along with the ability to produce steels and stainless steels directly, the present invention has the added advantage of significantly simplifying the production process while also reducing the need for substantial capital facilities. Unlike current steel production techniques that require the use of a coke oven, a blast furnace and a basic oxygen furnace (BOF), the present method eliminates the need for such processing. In the case of stainless steel production, the need for an argon oxygen degassing step is eliminated as well.

It is noted that the present invention is not intended to be limited to processes using molten oxide electrolytes. Rather, the invention could also be applied to processes in which a fluoride based electrolyte is used in an electrolytic cell. For example, one could have a consumable carbon free anode made of the cell feed material which dissolves into a fluoride-based electrolyte. Electrolytes based upon molten materials such as molten sulfides and selenides are contemplated for use with the invention as well.

As such, the present invention relates to the discovery that materials that are, under the operating conditions of the metal production cell, electronically conductive as a solid and provide an ironically conductive medium either when molten or when dissolved in a liquid, and can serve as consumable anodes for metal production cells wherein the anode dissolves into the electrolyte of the cell, thereby providing a feed material for the ultimate cell product.

An example of one such cell, for the production of titanium metal, is presented schematically in FIG. 1. In FIG. 1, the electrolytic cell 10 comprises a steel shell 12 having a layer of thermal and electrical insulation 14 disposed on its inner surface. A cell lining 15 lines the interior surfaces of the cell and prevents attack on the insulation by the molten electrolyte. In the embodiment shown, the cell lining 15 comprises a frozen layer of electrolyte situated on at least a portion of the electrical insulation 14. A cathode 16, formed of carbon or an electronically conductive ceramic as for example a refractory metal boride, is positioned at the bottom of the cell and is grounded by current collector bars 18 which communicate with the outside of the cell. Above the cathode, and on the cell interior, there is a molten electrolyte 20 of the type described previously. A first consumable anode 22 comprising a sintered body 24 of titanium oxide with a anode rod 26 embedded therein is lowered into the electrolyte, and direct current is supplied to the anode rod. As the anode is consumed by dissolution into the electrolyte 20, electrolytic action causes elemental titanium to form a molten metal pool 28 on the cathode surface. A second anode 30 comprising a sintered titanium oxide block 32 having an anode rod embedded therein stands ready above the electrolyte Upon dissolution of the first anode 22 to a predetermined degree, the second anode 30 can be lowered into the electrolyte, thereby allowing the first anode to be removed and allowing the process to operate continuously. By cycling fresh anodes through the system, the cell can be provided with feed material and electric current constantly, thereby allowing a continuous cell operation, and eliminating the need to shut down or cool the cell during anode replacement.

The electrolytic cell of FIG. 1 is intended only for purposes of illustration and is not intended to limit the current electrolytic cell to any particular variety. Rather, the invention is well suited for use with a variety of electrolytic cell, and/or anode configurations that would allow the anode to be slowly lowered into the electrolyte, thereby providing a continuous feed as well as a source of electrical current for the cell.

Equivalents

Those skilled in the art will recognize or be able to ascertain, using no more than routine experimentation, many equivalents to the specific embodiments of the invention described herein. Such equivalents are intended to be covered by the following appended claims.

What is claimed is:

1. An electrolytic cell for the production of metals, the cell adapted to contain an electrolyte and comprising an anode fabricated of a metal-containing compound that directly dissolves under the operating conditions of the cell to form a dissolution product, wherein the dissolution product comprises a feed material for the cell, and further wherein the anode compound, under the operating conditions of the cell, is electronically conductive as a solid and can provide an ironically conductive medium when molten or dissolved in a liquid.

2. An electrolytic cell as in claim 1 wherein the electrolyte comprises a molten oxide.

3. An electrolytic cell as in claim 1 wherein the anode comprises a monolith of $TiO_2$.

4. An electrolytic cell as in claim 3 wherein the anode comprises a sintered matrix of $TiO_2$.

5. An electrolytic cell as in claim 3 wherein the electrolyte comprises a molten mixture of $TiO_2$ and oxides of metals more reactive than titanium.

6. An electrolytic cell as in claim 5 wherein the electrolyte comprises a molten mixture of $TiO_2$ and oxides of lithium, calcium or a combination thereof.

7. An electrolytic cell as in claim 1 wherein the anode comprises a monolith of $UO_2$.

8. An electrolytic cell as in claim 7 wherein the electrolyte comprises a molten mixture of $UO_2$ and oxides of metals more reactive than uranium.

9. An electrolytic cell as in claim 8 wherein the electrolyte comprises a molten mixture of $UO_2$ and oxides of calcium, magnesium or a combination thereof.

10. An electrolytic cell as in claim 1 for the production of steel wherein the anode comprises iron oxide and the electrolyte comprises a molten oxide.

11. An electrolytic cell as in claim 1 for the electrolytic production of stainless steel wherein the anode comprises a monolith of oxides or iron, chromium and nickel in proportion to the relative desired compositions of such elements in the desired product.

12. An electrolytic cell as in claim 11 wherein the monolith comprises a sintered matrix.

13. An anode for use in an electrolytic cell for the production of metals, wherein the anode is associated with an electrolyte during operation of the cell and the anode comprises a metal-containing compound that, under the operating conditions of the cell will directly dissolve into the electrolyte, and further wherein the anode compound, under the operating conditions of the cell, is electronically conductive as a solid and can provide an ironically conductive medium when molten or dissolved in a liquid.

14. An anode for use in an electrolytic cell as in claim 13 wherein the electrolyte comprises a molten oxide.

15. An anode for use in an electrolytic cell as in claim 13 wherein the anode comprises a monolith of $TiO_2$.

16. An anode for use in an electrolytic cell as in claim 15 wherein the anode comprises a sintered matrix of $TiO_2$.

17. An anode for use in an electrolytic cell as in claim 16 wherein the electrolyte comprises a molten mixture of $TiO_2$ and oxides of metals more reactive than titanium.

18. An anode for use in an electrolytic cell as in claim 17 wherein the electrolyte comprises a molten mixture of $TiO_2$ and oxides of lithium, calcium or a combination thereof.

19. An anode for use in an electrolytic cell as in claim 18 wherein the anode comprises a monolith of $UO_2$.

20. An anode for use in an electrolytic cell as in claim 19 wherein the electrolyte comprises a molten mixture of $UO_2$ and oxides of metals more reactive than uranium.

21. An anode for use in an electrolytic cell as in claim 20 wherein the electrolyte comprises a molten mixture of $UO_2$ and oxides of calcium, magnesium or a combination thereof.

22. An anode for use in an electrolytic cell as in claim 13 wherein the anode comprises a monolith of $UO_2$.

23. An anode for use in an electrolytic cell as in claim 22 wherein the electrolyte comprises a molten mixture of $UO_2$ and oxides of metals more reactive than uranium.

24. An anode for use in an electrolytic cell as in claim 23 wherein the electrolyte comprises a molten mixture of $UO_2$ and oxides of calcium, magnesium or a combination thereof.

25. An anode for use in an electrolytic cell as in claim 13 for the production of steel wherein the anode comprises iron oxide and the electrolyte comprises a molten oxide.

26. An anode for use in an electrolytic cell as in claim 13 for the electrolytic production of stainless steel wherein the anode comprises a sintered matrix of oxides of iron, chromium and nickel in proportion to the relative desired compositions of such elements in the desired product.

27. An anode for use in an electrolytic cell for the production of metals, wherein the anode is associated with an electrolyte during operation of the cell and the anode comprises a metal-containing compound that, under the operating conditions of the cell will directly dissolve into the electrolyte to provide at least one feed material for the cell, and further wherein the anode compound, under the operating conditions of the cell, is electronically conductive as a solid and can provide an ironically conductive medium when molten or dissolved in a liquid.

28. An anode for use in an electrolytic cell as in claim 27 wherein the electrolyte comprises a molten oxide.

29. An anode for use in an electrolytic cell as in claim 27 wherein the anode comprises a monolith $TiO_2$.

30. An anode for use in an electrolytic cell as in claim 27 wherein the anode comprises a sintered matrix of $TiO_2$.

31. An anode for use in an electrolytic cell as in claim 30 wherein the electrolyte comprises a molten mixture of $TiO_2$ and oxides of metals more reactive than titanium.

32. An anode for use in an electrolytic cell as in claim 31 wherein the electrolyte comprises a molten mixture of $TiO_2$ and oxides of lithium, calcium or a combination thereof.

33. An anode for use in an electrolytic cell as in claim 27 for the production of steel wherein the anode comprises iron oxide and the electrolyte comprises a molten oxide.

34. An anode for use in an electrolytic cell as in claim 27 for the electrolytic production of stainless steel wherein the anode comprises a monolith of oxides of iron, chromium and nickel in proportion to the relative desired compositions of such elements in the desired product.

* * * * *